US011808044B1

(12) United States Patent
Hinojosa et al.

(10) Patent No.: US 11,808,044 B1
(45) Date of Patent: Nov. 7, 2023

(54) ROOF PROTECTION SYSTEM

(71) Applicant: UIPCO, LLC, San Antonio, TX (US)

(72) Inventors: Cynthia Ann Hinojosa, Selma, TX (US); Andrew Jacob Contreras, San Antonio, TX (US); Lemont Williamson, San Antonio, TX (US); Igor Alexandre Gregorio, San Antonio, TX (US); Stephen Anthony Young, Boerne, TX (US); Jonathan Edward Seaton, San Antonio, TX (US); Chris Aaron Bodden, San Antonio, TX (US); Shirley Elizabeth Bunton, San Antonio, TX (US); Shayna Dickson, Boerne, TX (US); Ric M. Pena, Boerne, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 62 days.

(21) Appl. No.: 17/219,381

(22) Filed: Mar. 31, 2021

Related U.S. Application Data

(60) Provisional application No. 63/002,738, filed on Mar. 31, 2020.

(51) Int. Cl.
*E04D 5/08* (2006.01)
*E04D 5/04* (2006.01)
*E04H 9/16* (2006.01)

(52) U.S. Cl.
CPC ..... *E04D 5/04* (2013.01); *E04D 5/08* (2013.01); *E04H 9/16* (2013.01)

(58) Field of Classification Search
CPC .... E04D 5/02; E04D 5/04; E04D 5/06; E04D 5/08; E04D 5/10; E04D 5/12; E04D 5/14; E04D 5/141; E04D 5/142; E04D 3/3608; E04D 13/00; E04D 13/031; E04B 7/02
USPC ..... 52/90.2
See application file for complete search history.

(56) References Cited

U.S. PATENT DOCUMENTS 3,805,816 A * 4/1974 Nolte ..... E04G 21/28 182/138
3,806,391 A * 4/1974 Clay ..... E04B 1/76 220/592.21
4,016,323 A * 4/1977 Volovsek ..... B32B 5/20 427/373
4,283,888 A * 8/1981 Cros ..... A01G 9/1469 52/404.1
5,347,768 A * 9/1994 Pineda ..... E04D 1/34 52/DIG. 11

(Continued)

*Primary Examiner* — William V Gilbert
(74) *Attorney, Agent, or Firm* — Plumsea Law Group, LLC

(57) ABSTRACT

Systems and methods container for the protection of exterior surfaces of buildings and other outdoor structures are disclosed. The proposed systems are configured to offer a mesh-based covering that can be installed on surfaces such as roofs to safeguard the exterior surface from damage caused by hailstorms or other debris. The mesh covering can be colored to match the coloring of the roof surface and/or may be substantially transparent or comprise a material thin enough to remain imperceptible when viewed from a distance. Consumers can order the mesh material to match the appearance type of their homes. The mesh covering can be spaced apart from the roof surface to ensure the impact of hail does not affect the roof.

20 Claims, 10 Drawing Sheets

(56) References Cited

U.S. PATENT DOCUMENTS

| | | | | |
|---|---|---|---|---|
| 5,791,090 | A * | 8/1998 | Gitlin | E04H 9/14 52/DIG. 12 |
| 6,161,362 | A * | 12/2000 | Forbis, Sr. | F24F 5/0075 52/168 |
| 6,865,852 | B2 * | 3/2005 | Gower | E04H 9/14 52/506.01 |
| 7,264,012 | B2 * | 9/2007 | Slade | E04G 21/28 135/900 |
| 7,310,913 | B2 * | 12/2007 | Pierce | E04H 9/14 52/156 |
| 7,322,154 | B2 * | 1/2008 | Forbis, Sr. | E04F 10/08 47/20.1 |
| 8,393,055 | B2 * | 3/2013 | Gower | E04H 9/14 16/95 D |
| 9,422,732 | B2 * | 8/2016 | Gower | E04B 2/721 |
| 2019/0063105 | A1 * | 2/2019 | Kelly | E04G 21/28 |
| 2021/0054646 | A1 * | 2/2021 | Volin | A47B 85/06 |

* cited by examiner

ROOF PROTECTION SYSTEM

CROSS-REFERENCE TO RELATED APPLICATION

This application claims the benefit of U.S. Provisional Patent Application Ser. No. 63/002,738 filed on Mar. 31, 2020 and titled "Roof Protection System", the disclosure of which is incorporated by reference in its entirety.

TECHNICAL FIELD

The present disclosure generally relates to protective coverings for roofing structures, and in particular, to mesh netting configured to protect roofs from damage resulting from hail and other debris while maintaining the building's aesthetic appeal.

BACKGROUND

Exterior structures will generally be covered or sheltered by a roof or other surface that is designed for exposure to outdoor conditions. For example, roofs provide a very large surface area facing 'up' or at least partly angled in a direction toward the sky, which necessarily increases the possibility of impacts and in some cases damage from hail, wind-blown debris, and other unfavorable weather events. Roofing contractors and owners of such structures, whether they be residential or commercial, are well aware that the type of damage that can result from a hailstorm can be catastrophic.

In addition, because the damage that occurs is in the roof structure itself, the repair or replacement process can be costly and deeply affect people, structures, equipment, or other inventory stored within the affected buildings. For example, artwork, personal valuables, sensitive equipment, and documents are but a few possible items contained within a building that would be irrevocably damaged by contact with any significant amount of water. The roofing systems available today remain vulnerable to exposure to such dynamic weather elements. Attempts to add protective measures to these exterior surfaces are also frequently associated with a decrease in a building's aesthetic appearance.

There is a need in the art for a system and method that addresses the shortcomings discussed above.

SUMMARY

In one aspect, a method of protecting an outdoor structure in anticipation of damage resulting from exposure to hailstorms includes identifying a first appearance type of a first exterior portion of the outdoor structure, matching the first appearance type to a first mesh option of a plurality of mesh options, and obtaining a first protective sheet corresponding to the first mesh option. The method also includes arranging the first protective sheet to extend across and cover a first exterior portion of the outdoor structure, and securing and installing the first protective sheet onto the first exterior portion, the first protective sheet being spaced apart from the first exterior portion.

In another aspect, a method of providing protection to exterior structures from inclement weather includes receiving at least a first image of a first portion of a roof of an exterior structure, receiving a first request for a protective covering system for at least the first portion, and determining a first appearance type of the first portion of the roof based on the first image. The method also includes selecting a first mesh material with a second appearance type that is substantially similar to the first appearance type, and providing a protective covering system including a first protective sheet comprising the first mesh material.

In another aspect, a roof protection system includes a first mesh sheet. The first mesh sheet covers a first roof portion of a building, and is spaced apart from the first roof portion.

Other systems, methods, features, and advantages of the disclosure will be, or will become, apparent to one of ordinary skill in the art upon examination of the following figures and detailed description. It is intended that all such additional systems, methods, features, and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the invention. Moreover, in the figures, like reference numerals designate corresponding parts throughout the different views.

DESCRIPTION OF EMBODIMENTS

The following embodiments provide a method and system for preventing the damage to roofs caused by exposure to hail and other weather-related damage while retaining a building's overall aesthetic appearance. The proposed system offers a netting or mesh roof covering that can be installed on a roof to protect the roof from hail. The mesh covering can comprise strands of material thin enough so that the covering is nearly invisible when viewing the roof from below or from a distance. In another example, the netting could be colored to match the roof, making it less perceptible. In some cases, the netting can be held at a distance (i.e., spaced apart) from the surface of the roof to ensure falling hail is prevented from making contact with the roof through gaps or spaces formed within the mesh. Such a system may facilitate the preservation of a building's inventory and personal belongings and the integrity of their property.

Figure 1:
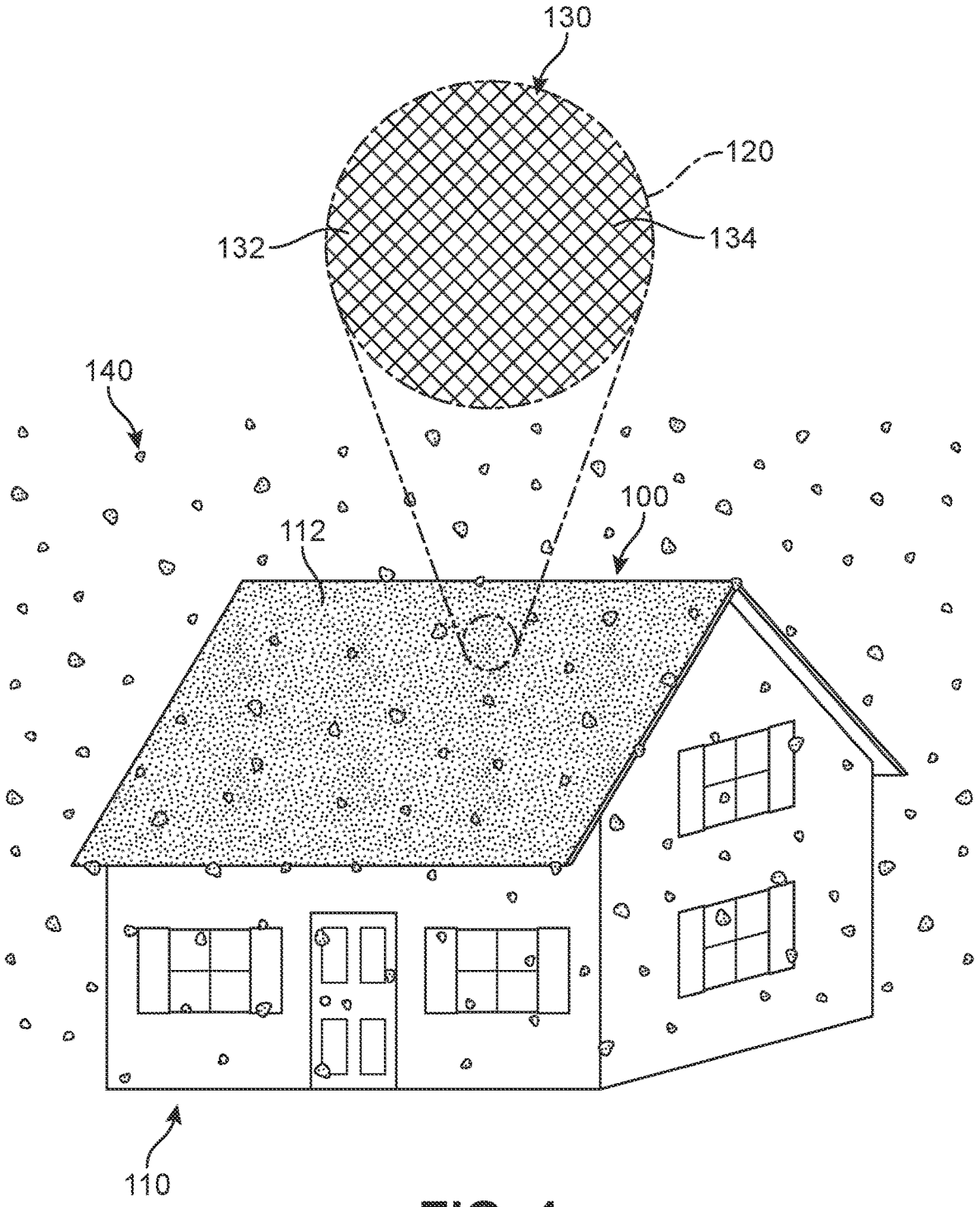
FIG. 1 is an example of a building including a mesh roof cover that offers protection from hail during a hailstorm, according to an embodiment.

For purposes of clarity, an overview of one embodiment of the proposed systems and methods is illustrated with reference to FIG. 1. In FIG. 1 an embodiment of a roof protection system ("system") 100 as installed on a building (here, a residence 110) is shown. As used herein, the term "building" or "outdoor structure" can refer to any kind of building, such as a home, or other residential building, a shed, barn, a commercial building or any other related structures. A building typically can include a roof, room, walls, support structures, windows, or other features.

In different embodiments, the system 100 includes one or more mesh sheets ("mesh sheets") that have been extended across to cover an exposed surface area of a roof 112 of the residence 110. As shown in an enlarged view 120 of FIG. 1, the mesh sheets include at least a first mesh sheet 130 in which a plurality of apertures ("apertures") 132 are formed within a network of plurality of strands ("strands") 134 that are interconnected or woven together. As hail 140 falls around and atop the roof 112 of the residence 110, rather than hit, impact, or land on the surface of the roof 112, the mesh sheets—whose apertures 132 are sufficiently small to ensure particles of hail are prevented from passing through the meshed layer—serve to protect the roof 112.

Figure 2:
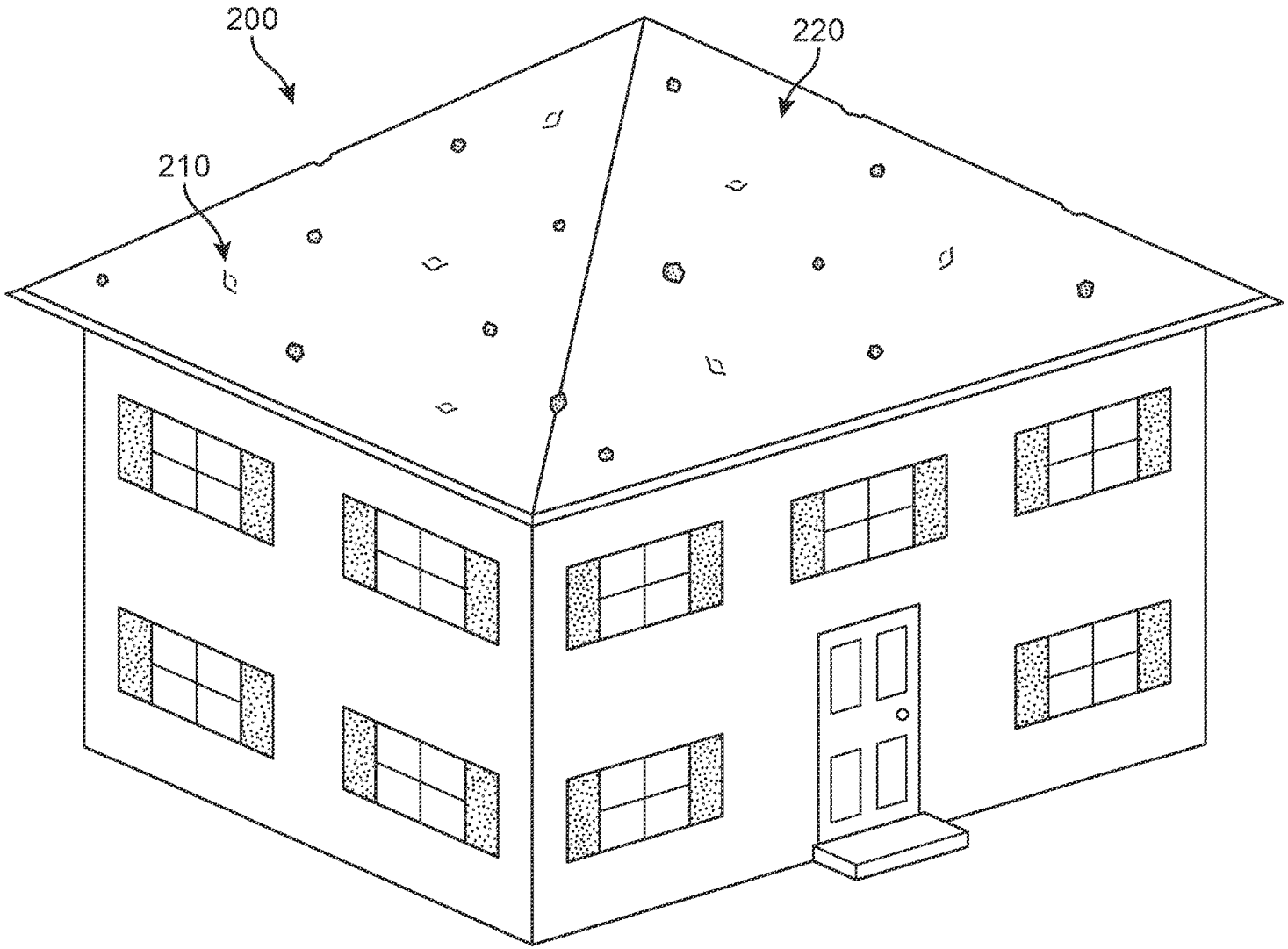
FIG. 2 is an example of a conventional residence and vehicles impacted by hail during a hailstorm, according to an embodiment.

For purposes of comparison, an example of a house 200 in which such a roof protection system has not been implemented is depicted. As noted earlier, conventional roofing structures 220 can be significantly impacted by unpredictable and turbulent weather. Hailstorms in particular can lead to lasting damage 210 to various roofing elements, including but not limited to roof shingles, as shown in FIG. 2. Of great concern to homeowners and other building managers is the recognition that roofing manufacturer warranties typically will not cover damage to a roof caused by hail. In addition, hail impact may cause latent damage that can, over time, result in premature aging of the shingles. In many cases, such damage is not visually obvious, and may not be apparent until months or years later, causing the shingles to age prematurely. Such hail damage can be seen as indentations and/or fractures on the shingle's surface. In cases where the exposed surfaces comprise other materials (i.e., glass, metal, slate, wood, tile etc.) the surface may be cracked or broken, reducing the life expectancy of the roof or other exposed area. Hailstones vary in size, shape, and hardness and can create a random pattern of dents or depressions. Damage can also be manifested by indentations on metal flashings, siding, chimney caps, or even skylight flashings, as well as vents or any other softer metal objects that may show impact. The effects on the shingle may not be apparent for about a year or longer, when circular areas of granules will fall off the shingle (referred to as spalling). With granules missing, the sunlight (UV) quickly attacks the asphalt and the maximum performance of the shingle has been compromised.

After some time, additional clusters of granules may come off (at and around the point of impact) in a random pattern and expose the asphalt. Granule loss at points of impact, which may be accompanied by surface depression can lead to the asphalt coating being directly exposed to the elements, leading to accelerated aging of the shingle. Therefore, granule loss is not merely cosmetic damage, but can expose or fracture the fiberglass mat, and loosen the self-seal strip. The exposed areas are then very susceptible to leaks and wind damage. Once leaks occur, the damage can be extensive due to potential damage from mold, electrical issues, ceiling and wall damage from water and perhaps even personal property losses. The damage can also come very quickly and often is not initially detected.

While it is possible to replace individual storm-damaged shingles, latent damage to the surrounding shingles caused by a storm can be difficult to assess. Because of the potential for the surrounding shingles to also have experienced storm damage, complete roof replacement is sometimes recommended for the long-term performance of these roofs. If the damage is confined to one plane of the roof, replacement of just the damaged roof plane may be possible, though this is frequently not the case. If individual shingles must be replaced, any nails removed from surrounding shingles must also be replaced and the surrounding shingles must be resealed by hand. The costs associated with these remedies can often be crippling to building owners.

Figure 3:
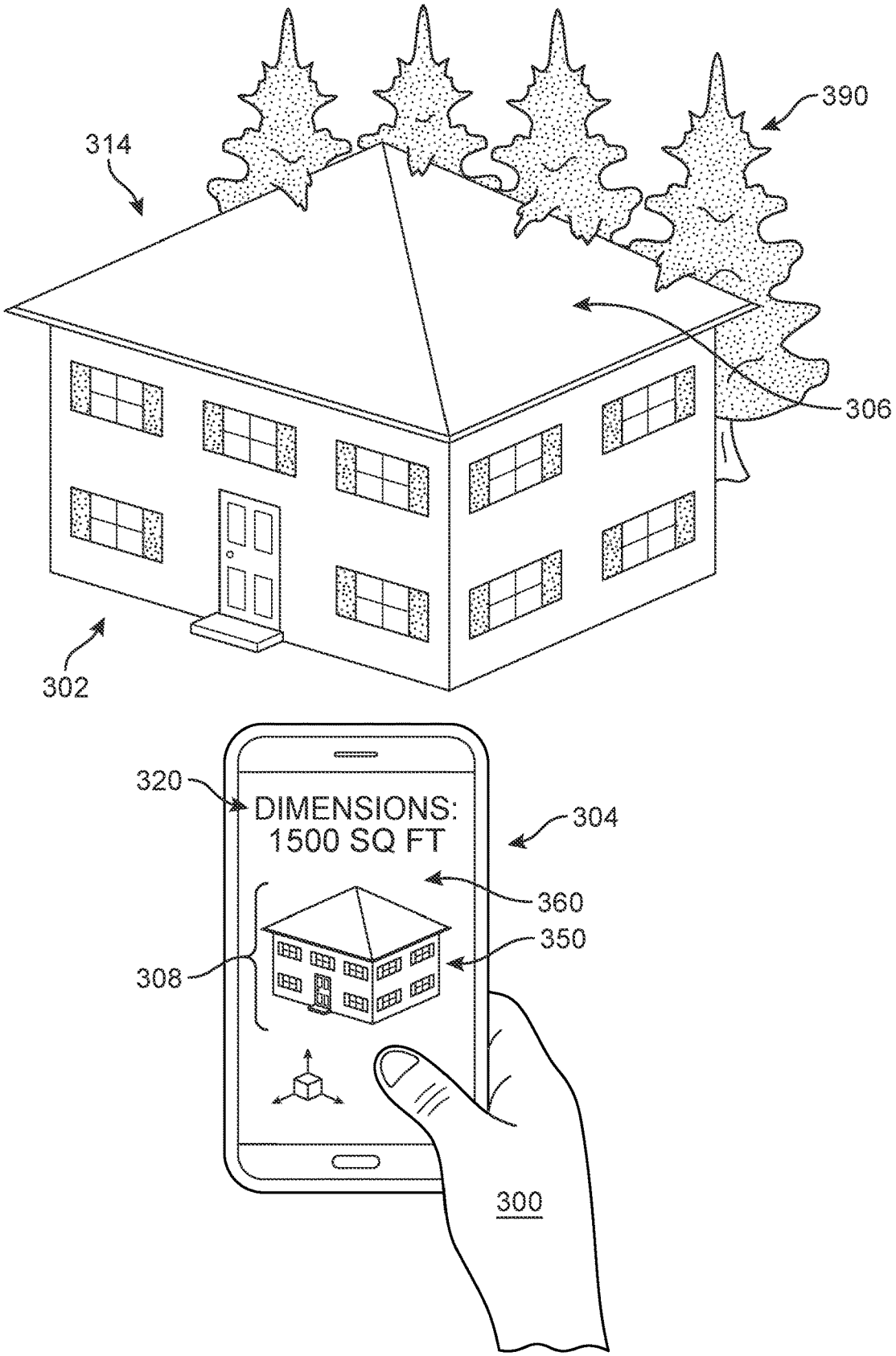
FIG. 3 is an example of a user capturing an image of a residence while submitting a request for a protective roof cover via a mobile device, according to an embodiment.

In order to address these concerns and reduce the damage caused by hailstorms, the proposed systems offer a protective mechanism by which hail can be 'filtered' or redirected before making contact with the roof surface (such as the shingles). This can be provided with little to no detrimental effect on the external appearance of the roof itself, which is of value to many building owners. FIGS. 3-8 present some non-limiting examples of such a system and its implementation. In FIG. 3, a building 302 with a roof 314 is shown. Building 302 is also disposed in close proximity or adjacent to tree foliage 390, which extends over and provides some cover to a hidden or rear portion of the roof 314. A user (represented here as a hand) 300 is shown capturing a first image 308 via a user computing device ("device") 304 of the building 302 in which at least a first roofing portion 306 is shown unprotected by any natural coverage. The user 300 can capture such an image and upload or submit it directly to a system provider, or the system provider can offer a consumer-friendly user interface system for capturing such data. Some exemplary devices may include, but are not limited to mobile phones, and tablets. In different embodiments, the device 304 may include one or more processors and memory. Memory may comprise a non-transitory computer readable medium. Instructions stored within memory may be executed by the one or more processors.

For example, in different embodiments, a computing system can be used in conjunction with or include an image capture device such as a camera. The camera can be used to capture an image of the roof. In one embodiment, this image can be processed by a 3D modeling system that can create a 3D model of a structure using the received imaging data. The device 304 may include provisions for capturing information about a building's structure. In some embodiments, device 304 includes provisions for capturing visual information about a building structure. In one embodiment, a device includes a range imaging camera, which can capture range information or range images corresponding to an object in the viewing area of the camera. As used herein, "range images" provide a 2D array of values indicating a depth (or distance measurement). Some exemplary range imaging devices may include structured-light 3D scanners and time-of-flight cameras. In one embodiment, the device 304 could be a smartphone with a built-in time-of-flight camera. Using a time-of-flight camera, device 304 can capture range images of a scene that can be used to build a 3D model of objects in the scene, such as building structures.

In different embodiments, the device 304 may also incorporate provisions for displaying models of building structures to a user. In some embodiments, an additional or alternative photographic camera comprising sensors for capturing lighting and/or color information that can be used to build a 2D photographic image of a scene. In some embodiments, augmented reality (AR) elements could be projected onto a display of the user device in order to better guide the user through the steps of obtaining the appropriate roof protection system. In other embodiments, a separate AR device, such as AR goggles, could be used to display AR information for a user.

In some embodiments, device 304 could be configured to communicate with a computing system or server over a network. Generally, a network can comprise any kind of network, including but not limited to a Wide Area Network (WAN), a Local Area Network (LAN), Wi-Fi network, Bluetooth or other Personal Area Network, cellular network, as well as other kinds of networks. It may be appreciated that different devices could communicate using different networks and/or communication protocols.

In other embodiments, a 3D modeling application could be configured to run on device 304, rather than on a separate system such as a server. In still other embodiments, some components of a 3D modeling system could be run on the user's device, while other components could be run on a server. In still other embodiments, a range imaging camera could be a separate device from device 304. In some cases, for example, range imaging camera could be a stand-alone camera or be built into an AR enabled device such as AR goggles.

It may be appreciated that the steps shown in FIGS. 3-8 may be performed by one or more components of a roof protection provisioning system. Specifically, some steps could be performed by a user device enabled with a range imaging camera, while other steps could be performed by a (possibly) separate computing system running 3D modeling software.

In FIG. 3, the user 300 captures information about building 302 via a user interface provided by a software application or app ("application") 350. Specifically, first image 308 is captured and shown on a display 360 of a smartphone. In some embodiments, the application may associate with the first image 308 a 2D array of different depths or distance values. Moreover, in some cases, range information (such as range images) may be captured along with color image data (that is, image data containing a 2D array of color values) and embedded in a data structure that contains both a 2D visual image of an object and associated range information.

In some cases, the range information can be sent from a user device to a remote computing system over a network. In other cases, the same device can be used to capture range information and to build a 3D model. The process of building a 3D model from range information can include steps of range image registration and reconstruction. During range image registration, multiple images of an object from different viewing angles may be collected and transformed into a common 3D coordinate system so that the range information for an entire object can be determined. This can include building a 3D surface of an object from a cloud of range points, or by merging locally constructed triangular meshes. The embodiments can use any known methods for registering (or aligning) range information from multiple images/files. The embodiments can also use any known methods for reconstructing 3D surfaces from range information.

In some embodiments, the resultant model can be configured to automatically estimate or determine the most likely dimensions and shape of an exterior surface of the building 302. For example, as the user 300 captures a static or video image of the building 302 from a first view point, the application may automatically generate display an approximate estimate 320 of the roof ("Dimensions: 1500 SQ FT"). This estimate can be improved as the user 300 continues to build an image repository of the building 302 and submits answers to various questions regarding the building and the roof protection system desired.

As noted earlier, the proposed systems can also include the provisions for a providing an unobtrusive, attractive roofing cover. For example, once the user 300 submits the image data, the application 350 may automatically detect the color or other appearance features and characteristics of at least a first portion of the roof. In FIG. 4A, the device 304 presents a detected appearance type 420 on display 360 via a user interface. The user 300 is asked to confirm the detected appearance type 420 via a first selectable option 422, which will assign this appearance type to the protective mesh that will be selected for the building. Alternatively, the user 300 may choose a second selectable option 430 to discard or set aside the automatically generated appearance type and proceed to a different menu.

In the figures depicted, different examples of a user interface ("interface") are presented on a touchscreen display of a mobile device, offering content via native controls included in the interface. Throughout this application, an "interface" may be understood to refer to a mechanism for communicating content through a client application to an application user. In some examples, interfaces may include pop-up windows that may be presented to a user via native application user interfaces (UIs), controls, actuatable interfaces, interactive buttons or other objects that may be shown to a user through native application UIs, as well as mechanisms that are native to a particular application for presenting associated content with those native controls. In addition, the terms "actuation" or "actuation event" refers to an event (or specific sequence of events) associated with a particular input or use of an application via an interface, which can trigger a change in the display of the application. This can include selections or other user interactions with the application, such as a selection of an option offered via a native control, or a 'click', toggle, voice command, or other input actions (such as a mouse left-button or right-button click, a touchscreen tap, a selection of data, or other input types). Furthermore, a "native control" refers to a mechanism for communicating content through a client application to an application user. For example, native controls may include actuatable or selectable options or "buttons" that may be presented to a user via native application UIs, touch-screen access points, menus items, or other objects that may be shown to a user through native application UIs, segments of a larger interface, as well as mechanisms that are native to a particular application for presenting associated content with those native controls. The term "asset" refers to content that may be presented in association with a native control in a native application. As some non-limiting examples, an asset may include text in an actuatable pop-up window, audio associated with the interactive click of a button or other native application object, video associated with a teaching user interface, or other such information presentation.

In some embodiments (not shown in the drawings), the interface can include a welcome or header message(s), and/or a plurality of data input fields can also be presented.

Some non-limiting examples of such fields can include options directed to identification of the owner (e.g., name, phone number, address). In addition, the interface can provide a plurality of selectable options, such as navigation options (e.g., "Back", "Save", "Next"), or additional menu options for accessing other features or aspects of the profile. As a general matter, it should be understood that the text and specific wording shown in the figures are for purposes of illustration only and in no way limit the manner by which the application may communicate or receive information. In addition, in other embodiments, one or more options or other fields and text may appear differently and/or may be displayed or generated anywhere else on the screen(s) associated with the user's system, including spaced apart from, adjacent to, or around the user interface. In other words, the figures present only one possible layout of the interface, and do not in any way limit the presentation arrangement of any of the disclosed features.

Furthermore, in different embodiments, the application interface can be configured to present or offer alternative appearance options to a user. In FIG. 4B, a plurality of appearance options 450 is shown on display 360, where each option is associated with different degrees of visibility, color, texture, material type, and may further be characterized by varying mesh properties. In other embodiments, the application 350 may be configured to present a sequence of options, where selection of a first option, for example, selecting a specific color tone, will trigger another menu in which the options allow a user to choose the type of material that is desired (e.g., elastic, rigid, metal, textile, fabric, etc.), the texture of the material, the size or frequency of the apertures in the mesh, delivery and installation options, warranty information and choices, pricing range, size, shape (e.g., mesh squares, rectangles, triangles, curved segments, trapezoid, or other irregular or regular shapes), and other variations.

Figure 4C:
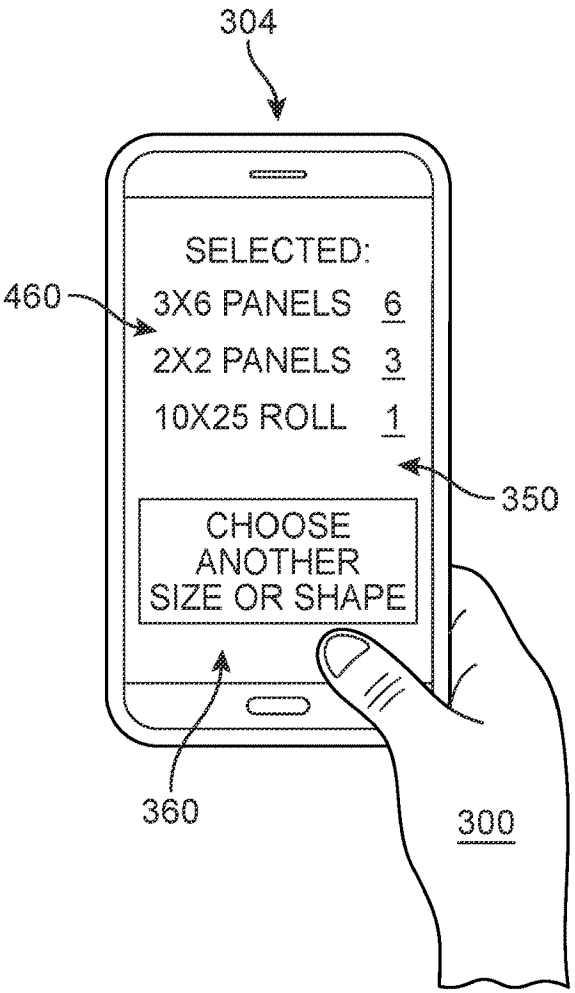
FIGS. 4A-4C is an example of different user interface experiences in which various mesh roof cover options may be presented and selected, according to different embodiments.
Figure 4B:
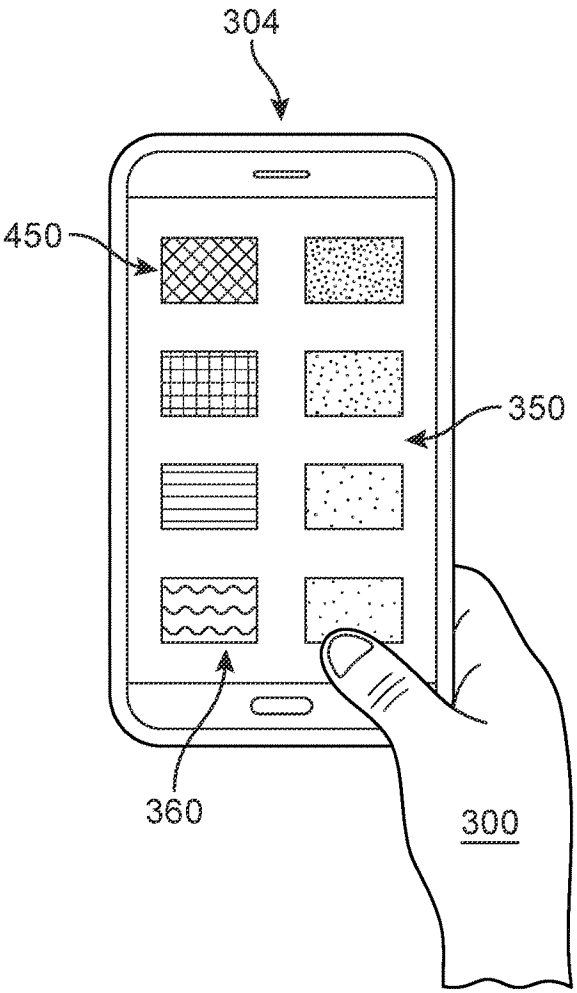
Figure 4A:
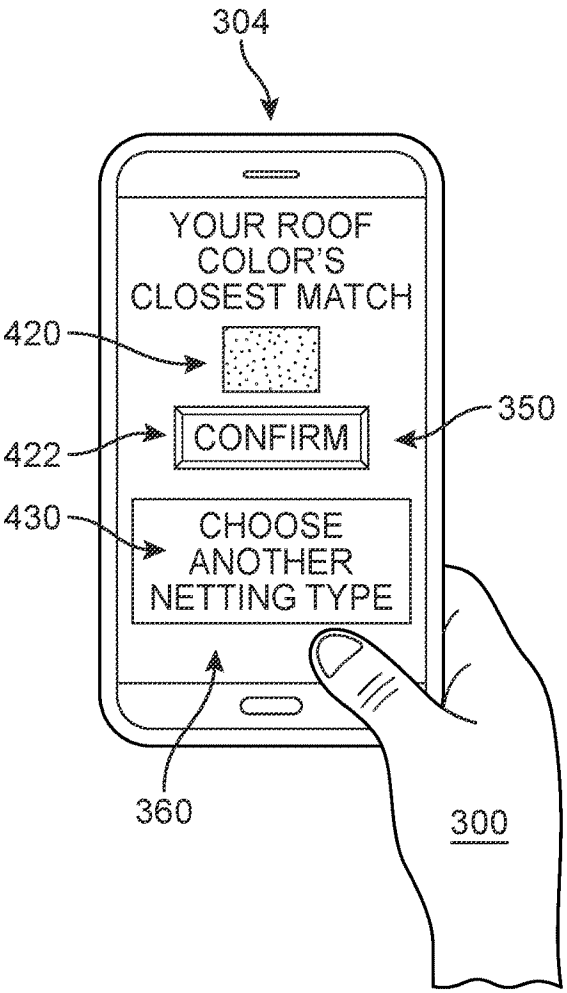

An example of such a menu is shown with reference to FIG. 4C, where the application 350 is presenting a summary 460 of the mesh covering selections that have been automatically determined by the system as being best suited to the building based on the image data submitted by the user 300. In this example, the summary of the mesh cover selections 460 includes a set of six 3×6 sq. ft. mesh panels, a set of three 2×2 sq. ft. mesh panels, and a 10×25 sq. ft. roll of mesh material. This has been calculated as corresponding to the user's desired amount of coverage for the building. If the user 300 wishes to adjust this amount or the mesh type, a third selectable option ("Choose another size or shape") 470 may be provided. The user 300 can make the final selections and submit a request for the personalized roof protection system. In other embodiments, this request can be submitted in person, by email, by mail, or by phone, and the user need not interact with the application 350 in order to order and/or obtain the desired system.

Figure 5:
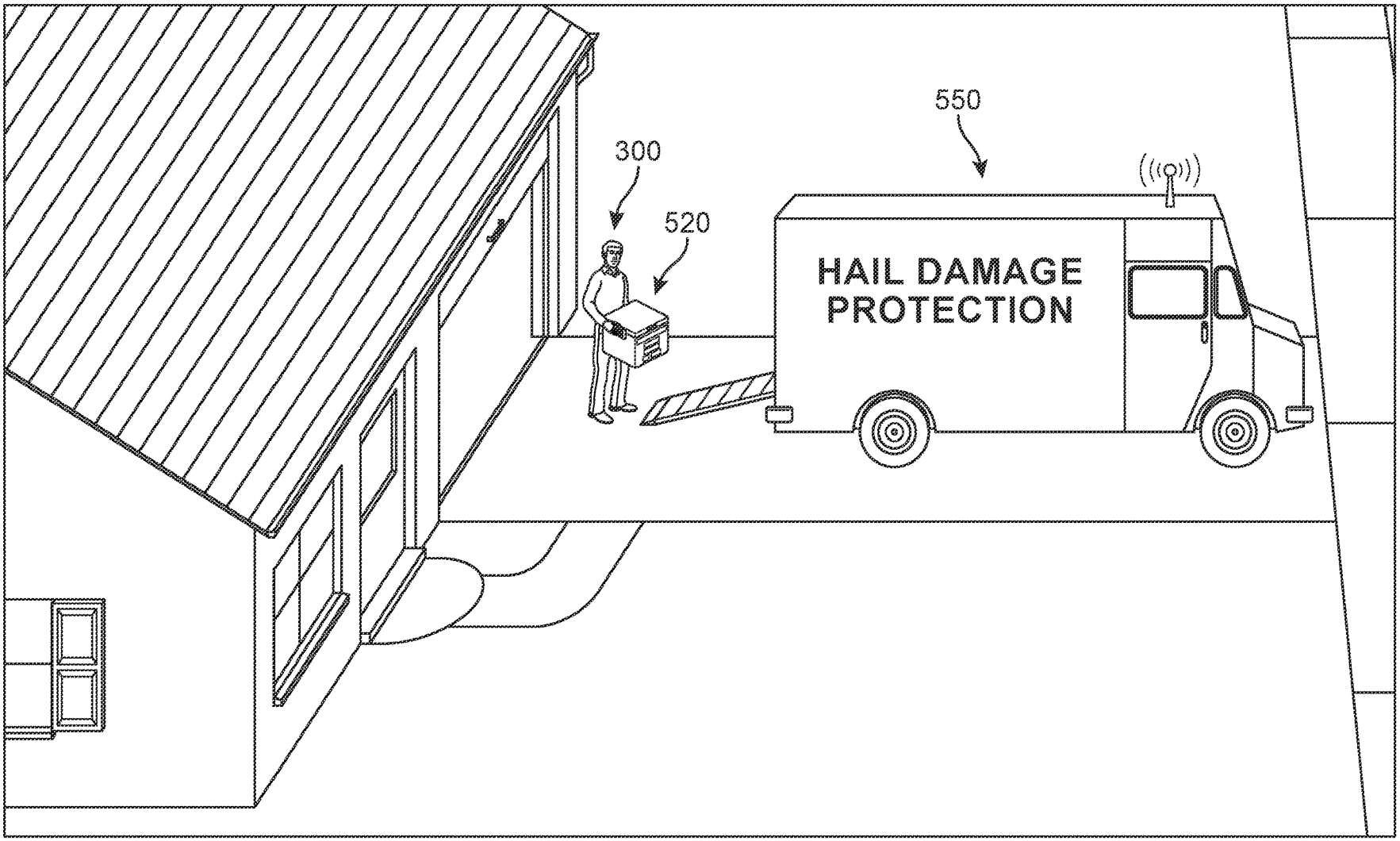
FIG. 5 is an example of a person receiving a roof protection system, according to an embodiment.
Figure 6:
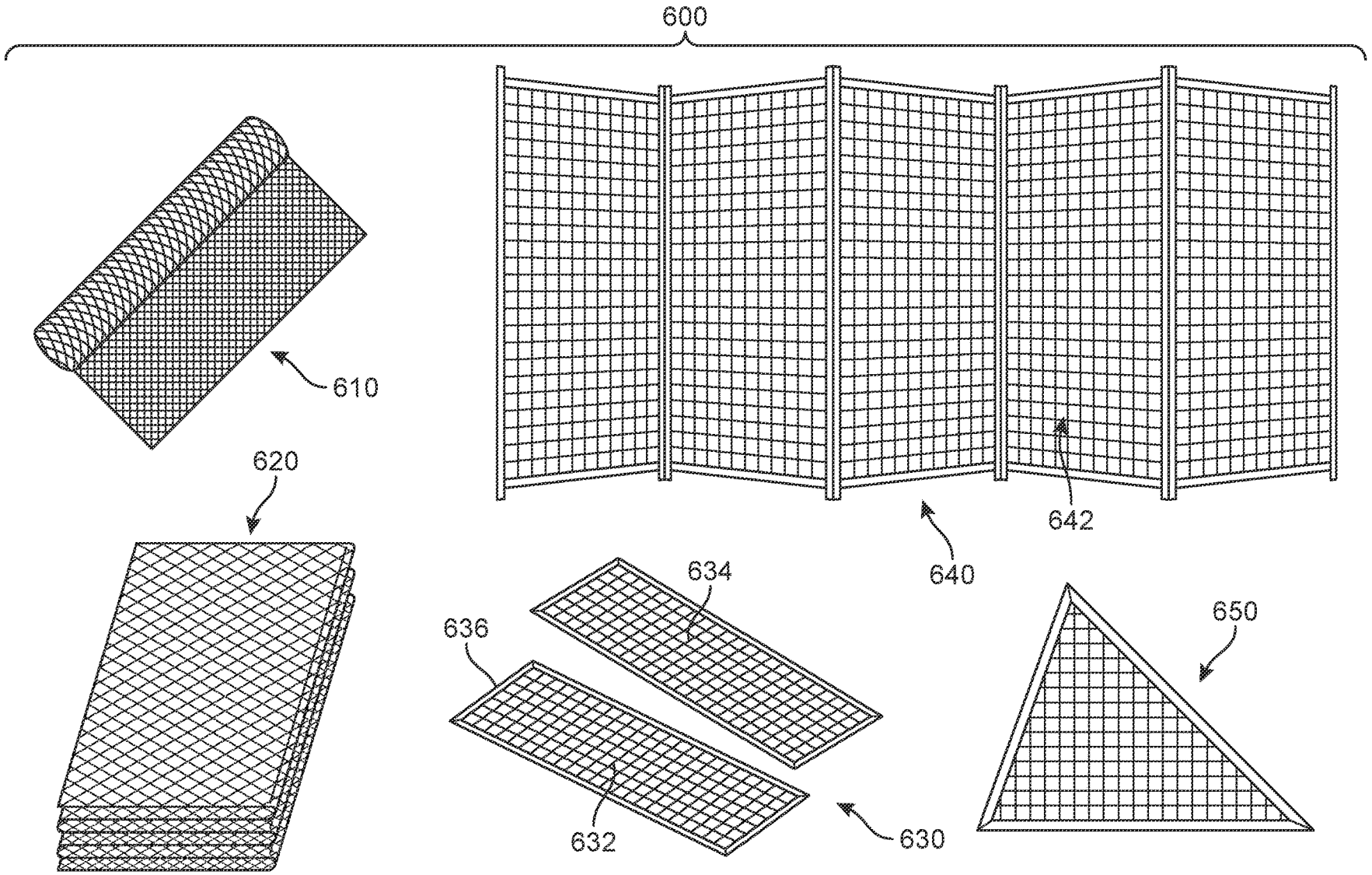
FIG. 6 is a depiction of some possible mesh roof cover types that may be implemented by the roof protection system, according to some embodiments.

In response to this order, a roof protection service 550 can deliver or otherwise provide the user 300 with a customized roof protection system ("customized system"), as illustrated in FIG. 5. In this case, the user 300 has received a first package 520 (here, a box or container) of a shipment comprising the customized system. In different embodiments, the one or more packages can include various system parts, such as the mesh covering, installation equipment, and/or instructions. In FIG. 6, several examples of mesh coverings 600 that may be offered for use in a customized system. A first mesh covering 610 comprises a roll of mesh netting that may be unrolled and spread across a roof surface. The roll can be fully unrolled to reveal a specific size as desired by the user, or may be cut into smaller sections to match a size and/or shape of specific portions of the roof. Similarly, a second mesh covering 620 is shown as a folded mesh fabric that may be unfolded to reveal a larger size and/or shape corresponding to a specific portion of the roof, or included pre-perforated regions for quick separation of various mesh piece sizes and shapes.

A third mesh covering 630, shown here as a set of two screens or panels 632 and 634, illustrate a possible embodiment in which the mesh may be framed or stretched between or bounded within a rigid border of material that can serve to support and maintain a specific surface area of the mesh while supporting the mesh itself. In some embodiments, such a frame 636 can include a thickness that, when the frame is disposed on a roof, can raise the mesh by a height sufficient to ensure adequate or appropriate hail protection. In other words, the mesh material may be disposed along a first side of the frame, and the remainder of the frame extends distally away from the mesh to provide the desired spacing between the roof surface and the mesh. In one embodiment, the frame 636 can include a substantially transparent and/or translucent material, such as glass, PVC, acrylic, polycarbonate, plexiglass, polyethylene, fiberglass, vinyl, or other appropriate roof-friendly materials to decrease the visibility or obtrusiveness of the panels. A fourth mesh covering 640 is shown to comprise a plurality of panels 642, similar to panels 632 and 634, that have been hingedly or otherwise flexibly connected that are able to offer the same benefits as individual panels. Once unfolded, the panels can be configured to extend across and provide a larger coverage area for the roof. Finally, a triangular shaped panel is shown as a fifth mesh covering 650 to illustrate an example of an alternate shape that may be obtained for a particular roof portion (i.e., that may be triangular in shape). Other regular or irregular shapes may also be readily produced and obtained for use in the system.

Figure 7:
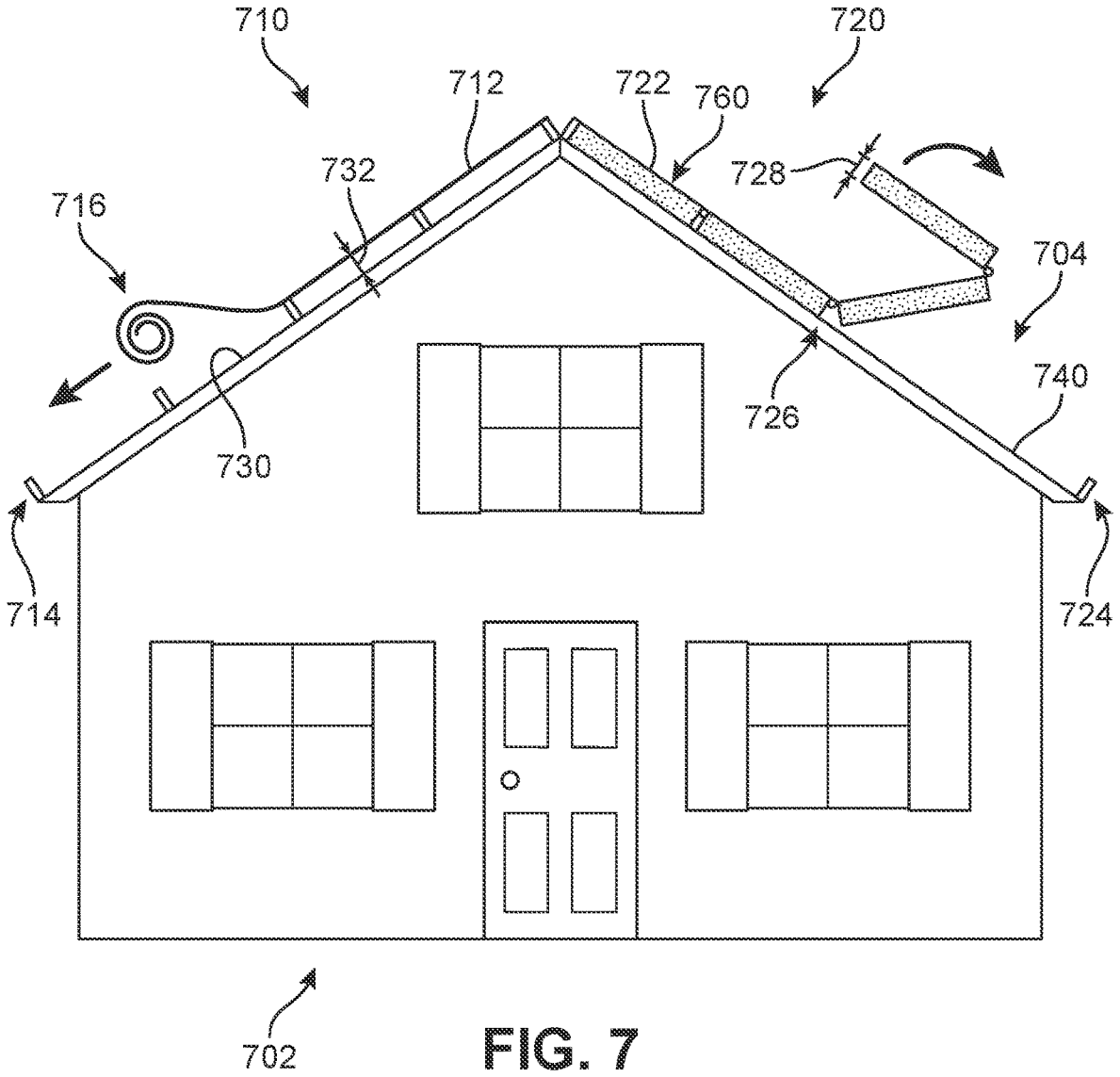
FIG. 7 is a front view of a home illustrating two different installation mechanisms for the roof protection system, according to some embodiments.

In FIG. 7, two examples of an installation process are depicted, including a first installation process ("first process") 710 and a second installation process ("second process") 720. For purposes of simplicity, the two examples are presented on two sides of the same house (building 702) to allow the reader to follow both processes in a side-by-side view. In first process 710, a roll 716 of a first mesh material 712 is being unrolled across a first exterior portion 730 of a roof 704. It can be seen that first mesh material 712 is spaced apart by a first distance 732 from the surface of roof 704. This can be facilitated by the installation of one or more racking or rail elements 714 that can be used to both anchor and secure the mesh to the roof and raise the mesh over the roof. Furthermore, in some embodiments, the mesh material can include one or more reinforced loops, slots, or apertures along its outermost periphery configured to permit a stretch-and-anchoring process with protrusions in or associated with the rail elements 714. Although the rail elements 714 are shown as extending along or being aligned with a horizontal direction (from one side to another of the house) of roof 704, in other embodiments, the rail elements 714 can extend in a more vertical direction from a top or upper region of the roof 704 to a bottom or lower region of the roof 704.

In second process 720, a plurality of interconnected panels ("panels") 760 are unfolded across a second exterior portion 740 of the roof 704. In some embodiments, the panels 760 are joined together by hinges 726. It can further be seen that a thickness 728 of frame extending along portions of the panels 760 ensure that, as the panels 760 are unfolded and become aligned with the plane of the roof 704, a second mesh material 722 remains spaced apart by a distance approximately corresponding to the thickness 728 of the frame. In addition, in some embodiments, installation of one or more racking or rail components 724 and/or adhesives or other fastening or connective mechanisms can be used to secure the mesh to the roof.

In different embodiments, a variety of installation components may be used or provided with the mesh covering. In some embodiments, this may necessitate or involve the drilling of holes that can be protected from water damage by the installation of flashing (i.e., material used to stop water from leaking, usually in the form of an aluminum rectangle). On a traditional asphalt tile roof, flashing is inserted underneath shingles. For roofs made with tile, metal, rubber, or wood, there are specially designed flashings that fit the unique shape of your roofing material. The mesh panels can be attached to the roof with mounts with a bolt through the flashing and into a rafter, securing the system. There are many varieties of mounts used in different racking systems that may be used that are known in the art of roofing installations. The mounts are configured to hold up rails, which are the component of the installation that the mesh panels or netting can rest directly on top of or be secured to. These typically comprise long aluminum tracks that are installed either vertically or horizontally on a roof plane. There are several types of alternative rail setups to standard rails, such as rail-less or shared-rail, known in the art. An added benefit of rails is that they help to reduce clutter and improve the safety and aesthetics of your installation. In some embodiments, the rails and other mounting components can be painted in the same color as the roof, can comprise substantially transparent materials (as described above for the frames bordering mesh panels), and/or be substantially thin or narrow to reduce visibility. Finally, in some embodiments, the system can include clamps to keep the mesh netting or panels secured in place on the racking.

Figure 8:
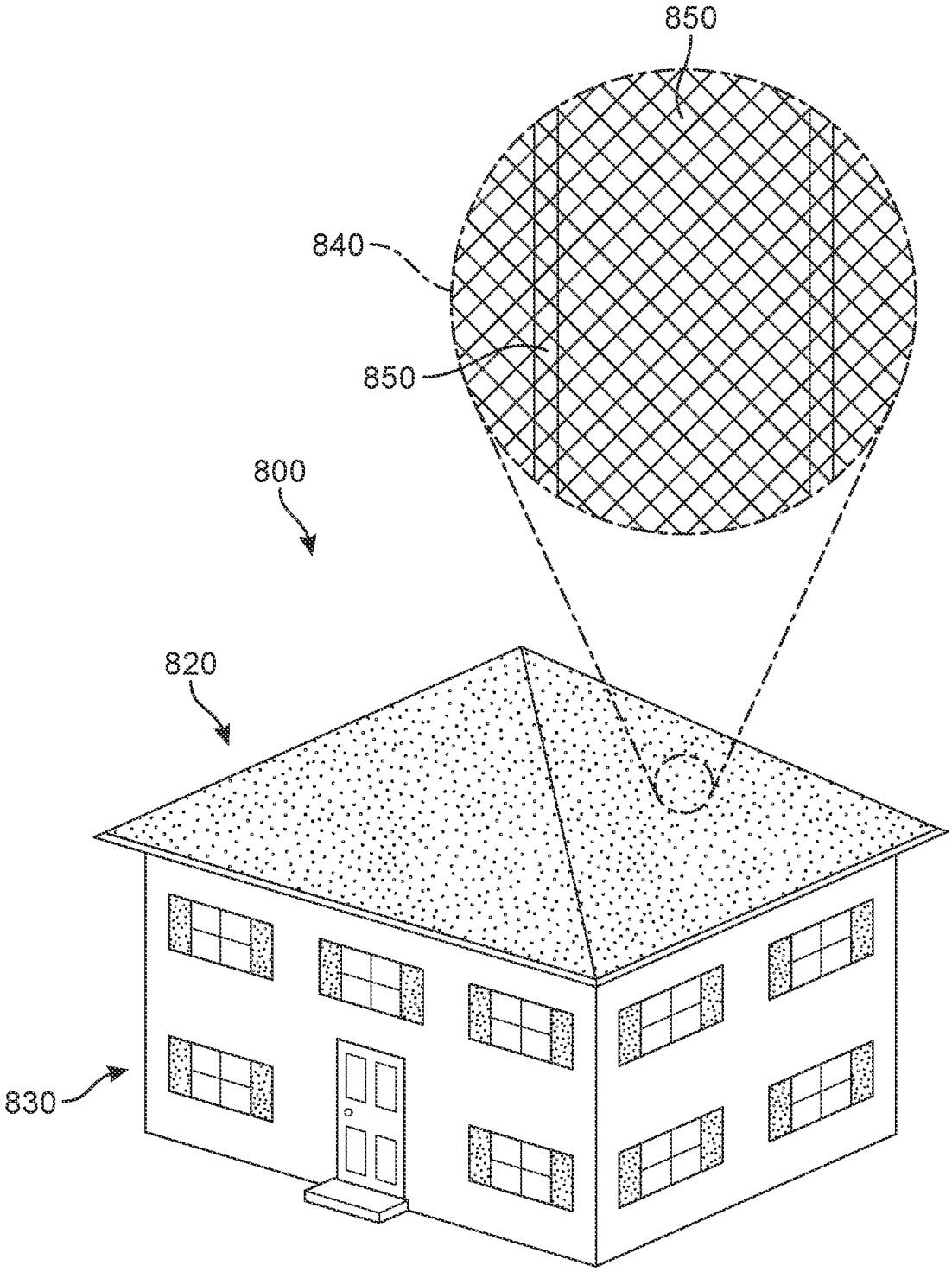
FIG. 8 is a magnified view of a portion of a roof in which the roof protection system has been installed, according to an embodiment.

Referring now to FIG. 8, an example of an installed roof protection system 800 is shown. A plurality of mesh screens or panels is depicted (here by a stippling drawing effect across the surface of roof 820) covering a substantially entirety of the roof 820 of a home 830. In a first enlarged view 840, a first region of a mesh covering 850 is shown, extending across and secured to a plurality of rails 852 that in this case extend in top-down direction.

As noted earlier, the mesh material used in each customized system can vary widely. For example, in different embodiments, the mesh material can comprise one or a combination of two or more of a textile, fabric, metal screen, perforated metal sheet or grid. The material used can be selected based on the desired strength, durability, resilience, as well as a strong resistance to wrinkling, shrinking, fading, mildew and fungus. Materials that are water resistant, can dry quickly, and are UV resistant can also be used. Some non-limiting examples of such materials include woods fibers and filaments, metals (e.g., stainless steel, aluminum, iron), resins and plastics (e.g., synthetic resin, recycled plastic, high-density polyethylene, polypropylene, polycarbonate, acrylic or Polymethyl Methacrylate (PMMA)), as well as high pressure laminate, tempered glass, fabrics (e.g., acrylic fabric, olefin fabric, polyester fabric), and/or foams (e.g., core foam, open cell foam, closed cell foam, polyethylene terephthalate foam, polyurethane foam, polyester foam).

In addition, the structure of the mesh material should be substantially indistinguishable from the roofing on which it is installed. This can be a feature provided by the relative thinness of the strands comprising the mesh, the spacing arrangement, the use of clear or substantially transparent materials, and—as described earlier —materials that are in appearance close approximations of the underlying roof appearance. In some embodiments, the mesh material can be configured to appear similar in appearance to the roof shingles to increase the camouflage effect. Furthermore, the proposed system allows for the installation of a plurality of mesh panels or portions that differ in appearance, in order to best correspond to the individual distinct regions that may be used in roofing structures. For example, red shingles may be used along one side of a building, which brown shingles are used on an opposite side. The mesh materials that are selected—whether by the user or automatically determined by the system—can provide appropriately sized and shaped segments to match the red shingles and appropriately sized and shaped segments that match the brown shingles.

Figure 9:
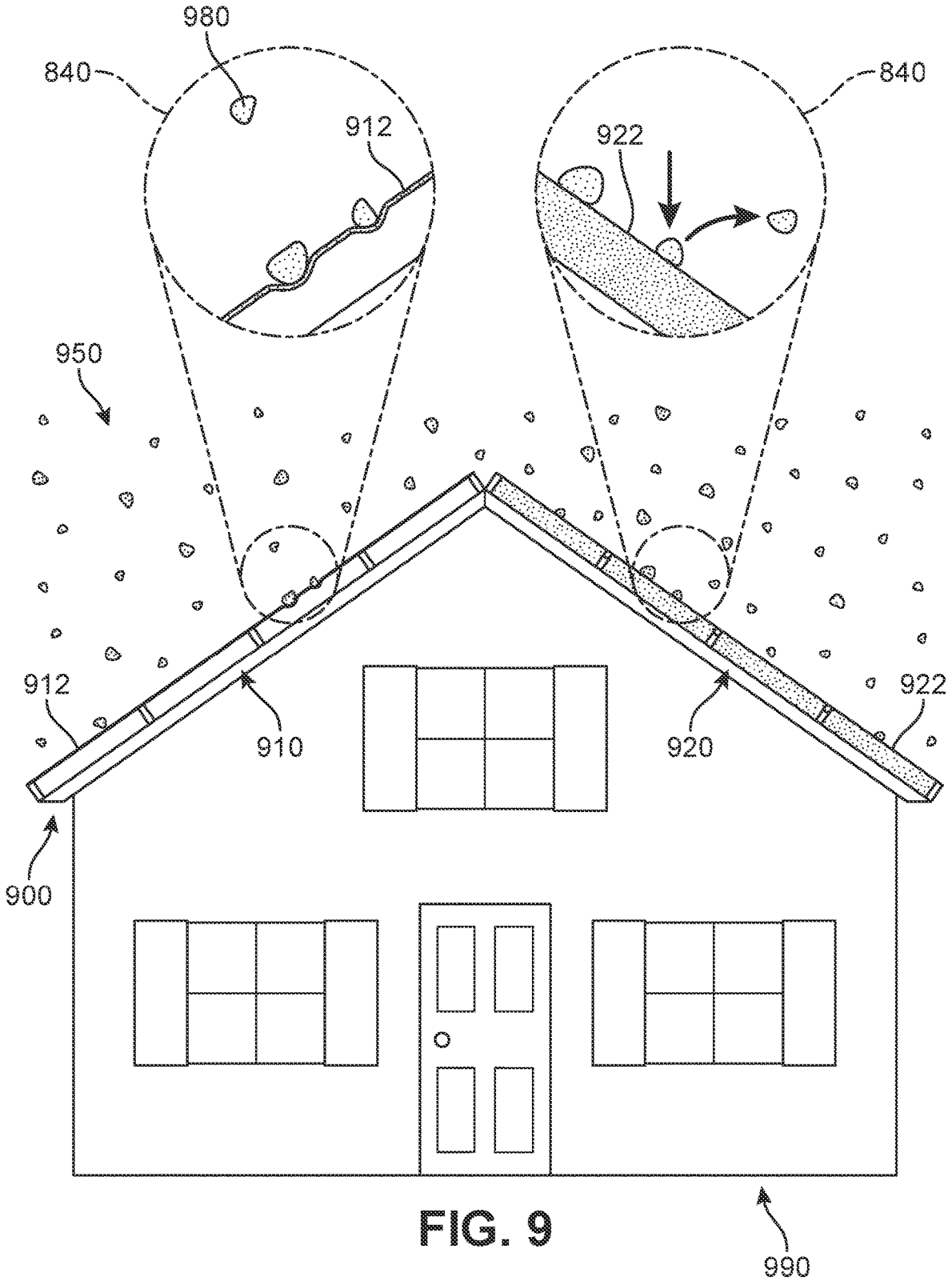
FIG. 9 is a front view of a home in which the roof protection system has been implemented and is serving as a protection from hail damage, according to an embodiment.

As shown in the example of FIG. 9, the roof protection system is configured to serve as a shield or buffer that can serve to protect or safeguard the structural integrity of the target roof. An elastic mesh 912 configured to stretch in response to impact by a piece of hail is shown on a first region 910 of a roof 900 of a building 990, and a rigid mesh 922 configured to substantially retain its shape upon impact by a piece of hail is shown on a second region 920 of the roof 900, each responding to an ongoing hailstorm 950. Both types of mesh are spaced apart or above their corresponding roof regions. However, it can be appreciated that elastic mesh 912 may be spaced from the roof a greater distance than the rigid mesh 922. For example, as shown in first magnified view 960, as the elastic mesh 922 is impacted by hail 980, it 'gives' or is temporarily distorted or dilated inward (in a direction toward the roof) as it accommodates the force, weight, and size of a particular piece(s) of hail. Because the mesh is spaced apart from the roof surface (for example by at least a ½ inch to one-inch to a greater distance, depending on the elasticity of the mesh and its relative tautness as it extends across the roof) the mesh material, as it stretches down, does not actually contact the roof, thereby protecting the roof from any damage. The hail 980 will eventually melt and drip off the roof (or evaporate) without any harm to the roof. In addition, in some other embodiments, as shown in the second magnified view 970, when the rigid mesh 924 is impacted by hail 980, it remains substantially flat and its apertures can serve to either catch or filter the hail from striking the roof surface below, or—depending on the speed and angle at which the hail impact occurs—reflects the hail off its surface (i.e., bounces), such that the hail is redirected elsewhere. In this case, the distance between the rigid mesh 922 and the roof surface can be less than the distance between the elastic mesh 912 and the roof surface because the rigid mesh 922 is not configured to bend or stretch inward (i.e., toward the roof), for example a distance of less than ½ an inch.

Figure 10:
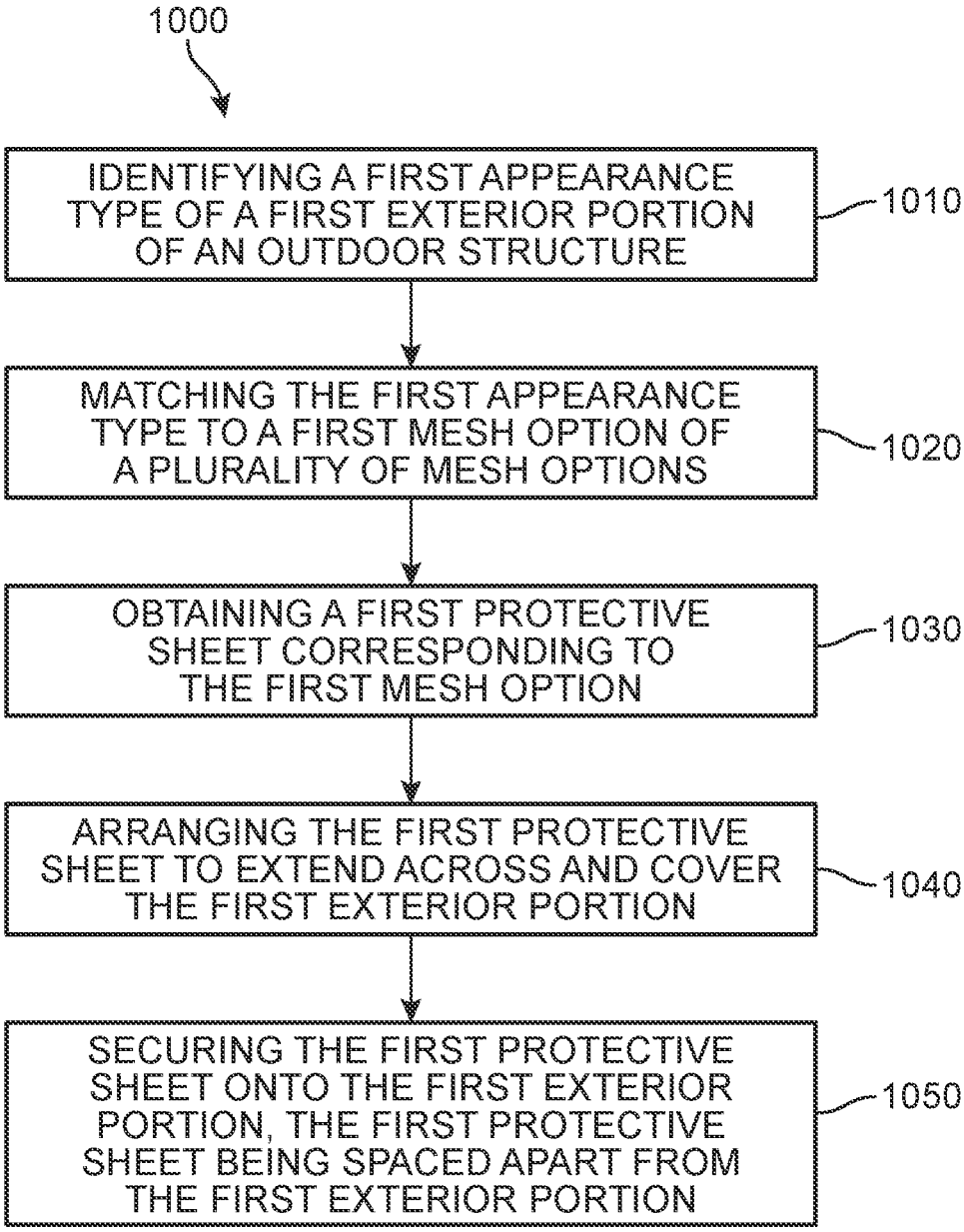
FIG. 10 is a flow chart presenting a method of protecting an outdoor structure in anticipation of damage resulting from exposure to hailstorms.

FIG. 10 is a flow chart illustrating an embodiment of a method 1000 of protecting an outdoor structure in anticipation of damage resulting from exposure to hailstorms. The method 1000 includes a first step 1010 of identifying a first appearance type of a first exterior portion of the outdoor structure, and a second step 1020 of matching the first appearance type to a first mesh option of a plurality of mesh options. In addition, the method includes a third step 1030 of obtaining a first protective sheet corresponding to the first mesh option, and a fourth step 1040 of arranging the first protective sheet to extend across and cover the first exterior portion of the outdoor structure. The method further includes a fifth step 1050 of securing and/or installing the first protective sheet onto the first exterior portion, where the first protective sheet is spaced apart from the first exterior portion.

In other embodiments, the method may include additional steps or aspects. In one embodiment, the method also includes determining a shape and dimensions of the first exterior portion, where the first protective sheet has substantially similar shape and dimensions as the first exterior portion. In another example, the method can include additional steps of identifying a second appearance type of a second exterior portion of the outdoor structure, where the second appearance type differs from the first appearance type, matching the second appearance type to a second mesh option of the plurality of mesh options, and obtaining a second protective sheet corresponding to the second mesh option. In some embodiments, the method may also include steps of selecting a second protective sheet including a substantially transparent mesh material, arranging the second protective sheet to extend across and cover a second exterior portion of the outdoor structure, and securing and/or installing the second protective sheet onto the first exterior portion.

In addition, in different embodiments, the first protective sheet is substantially indistinguishable from the first exterior portion when viewed by an observer. In one embodiment, the first protective sheet is spaced apart from the first exterior portion by at least a quarter of an inch upon installation. In some examples, the first protective sheet is substantially elastic, while in other examples the first protective sheet is substantially rigid. In some embodiments, the first exterior portion is a portion of a roof of the exterior structure. In one embodiment, the first protective sheet is substantially waterproof. In another example, the first protective sheet comprises a plurality of interconnected strands, where an average thickness of the strands is less than 1 millimeter, and in another example, the first protective sheet has a first color substantially similar to a second color of the first exterior portion.

Other methods can also be contemplated within the scope of this disclosure. For example, a method of providing protection to exterior structures from hailstorms may be provided, including steps of receiving at least a first image of a first portion of a roof of an exterior structure, receiving a first request for a protective covering system for at least the first portion, and determining a first appearance type of the first portion of the roof based on the first image. The method may further include selecting a first mesh material with a second appearance type that is substantially similar to the first appearance type, and providing a protective covering system including a first protective sheet comprising the first mesh material.

In other embodiments, the method may include additional steps or aspects. In one embodiment, the method also includes automatically detecting, based at least on the first image, the shape and dimensions of the first portion of the roof, where the first protective sheet has substantially similar shape and dimensions as the detected shape and dimensions of the first portion of the roof. In another example, the first protective sheet comprises a panel of mesh fabric bounded by a substantially rigid frame. In some cases, the first protective sheet comprises a metal wire mesh screen.

It may therefore be appreciated that the embodiments provide a roof protection system for protecting the exterior surfaces of a building during inclement weather conditions. Although the disclosed embodiments have described the application of these systems on roofing elements, it should be appreciated that such a system can be configured for use on non-roof exterior surfaces, just as windows, siding, and other vulnerable and exposed areas. In addition, because in some embodiments the system makes the mesh covering available as multiple segments of varying sizes and shapes, any repairs to either the roof or the mesh covering itself are made simple. The removal of a portion of the mesh can be straightforward, providing ready access to the roof as needed (for example, comprising a rolling back of the mesh material, or a folding back of the mesh panel or screens in the target roof sections). In addition, any tears or damage to the mesh material can be replaced as a piece, rather than in its entirety.

The processes and methods of the embodiments described in this detailed description and shown in the figures can be implemented using any kind of computing system having one or more central processing units (CPUs) and/or graphics processing units (GPUs). The processes and methods of the embodiments could also be implemented using special purpose circuitry such as an application specific integrated circuit (ASIC). The processes and methods of the embodiments may also be implemented on computing systems including read only memory (ROM) and/or random access memory (RAM), which may be connected to one or more processing units. Examples of computing systems and devices include, but are not limited to: servers, cellular phones, smart phones, tablet computers, notebook computers, e-book readers, laptop or desktop computers, all-in-one computers, as well as various kinds of digital media players.

The processes and methods of the embodiments can be stored as instructions and/or data on non-transitory computer-readable media. The non-transitory computer readable medium may include any suitable computer readable medium, such as a memory, such as RAM, ROM, flash memory, or any other type of memory known in the art. In some embodiments, the non-transitory computer readable medium may include, for example, an electronic storage device, a magnetic storage device, an optical storage device, an electromagnetic storage device, a semiconductor storage device, or any suitable combination of such devices. More specific examples of the non-transitory computer readable medium may include a portable computer diskette, a floppy disk, a hard disk, magnetic disks or tapes, a read-only memory (ROM), a random access memory (RAM), a static random access memory (SRAM), a portable compact disc read-only memory (CD-ROM), an erasable programmable read-only memory (EPROM or Flash memory), electrically erasable programmable read-only memories (EEPROM), a digital versatile disk (DVD and DVD-ROM), a memory stick, other kinds of solid state drives, and any suitable combination of these exemplary media. A non-transitory computer readable medium, as used herein, is not to be construed as being transitory signals, such as radio waves or other freely propagating electromagnetic waves, electromagnetic waves propagating through a waveguide or other transmission media (e.g., light pulses passing through a fiber-optic cable), or electrical signals transmitted through a wire.

Instructions stored on the non-transitory computer readable medium for carrying out operations of the present invention may be instruction-set-architecture (ISA) instructions, assembler instructions, machine instructions, machine dependent instructions, microcode, firmware instructions, configuration data for integrated circuitry, state-setting data, or source code or object code written in any of one or more programming languages, including an object oriented programming language such as Smalltalk, C++, or suitable language, and procedural programming languages, such as the "C" programming language or similar programming languages.

Aspects of the present disclosure are described in association with figures illustrating flowcharts and/or block diagrams of methods, apparatus (systems), and computing products. It will be understood that each block of the flowcharts and/or block diagrams can be implemented by computer readable instructions. The flowcharts and block diagrams in the figures illustrate the architecture, functionality, and operation of possible implementations of various disclosed embodiments. Accordingly, each block in the flowchart or block diagrams may represent a module, segment, or portion of instructions. In some implementations, the functions set forth in the figures and claims may occur in an alternative order than listed and/or illustrated.

The embodiments may utilize any kind of network for communication between separate computing systems. A network can comprise any combination of local area networks (LANs) and/or wide area networks (WANs), using both wired and wireless communication systems. A network may use various known communications technologies and/or protocols. Communication technologies can include, but are not limited to: Ethernet, 802.11, worldwide interoperability for microwave access (WiMAX), mobile broadband (such as CDMA, and LTE), digital subscriber line (DSL), cable internet access, satellite broadband, wireless ISP, fiber optic internet, as well as other wired and wireless technologies. Networking protocols used on a network may include transmission control protocol/Internet protocol (TCP/IP), multiprotocol label switching (MPLS), User Datagram Protocol (UDP), hypertext transport protocol (HTTP), hypertext transport protocol secure (HTTPS) and file transfer protocol (FTP) as well as other protocols.

Data exchanged over a network may be represented using technologies and/or formats including hypertext markup language (HTML), extensible markup language (XML), Atom, JavaScript Object Notation (JSON), YAML, as well as other data exchange formats. In addition, information transferred over a network can be encrypted using conventional encryption technologies such as secure sockets layer (SSL), transport layer security (TLS), and Internet Protocol security (Ipsec).

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A method of protecting structure in anticipation of damage resulting from exposure to hailstorms, the method comprising:

identifying a first color of a first exterior portion of the structure;

matching the first color appearance type to a color of a first mesh option of a plurality of mesh options;

obtaining a first protective panel based on the first mesh option, the first protective panel including a rigid frame having a first thickness, where a first mesh material of the first color is stretched across a first side of the frame and is bounded and bordered by the frame;

arranging the first protective panel to extend across and cover the first exterior portion of the structure; and securing the first protective panel onto the first exterior portion, the first mesh material being spaced apart from the first exterior portion by at least the first thickness of the frame.

2. The method of claim 1, further comprising determining a shape and dimensions of the first exterior portion, and wherein the first protective panel has substantially similar shape and dimensions as the first exterior portion.

3. The method of claim 1, wherein the first mesh material includes a plurality of apertures.

4. The method of claim 1, wherein the first mesh material is spaced apart from the first exterior portion by at least a quarter of an inch upon installation.

5. The method of claim 1, wherein the first mesh material is substantially elastic.

6. The method of claim 1, wherein the first mesh material is substantially rigid.

7. The method of claim 1, wherein the first exterior portion is a portion of a roof of the exterior structure.

8. The method of claim 1, wherein the first mesh material is spaced apart from the first exterior portion by a distance that is selected based on an elasticity of the first mesh material.

9. The method of claim 1, wherein the first protective panel is hingedly connected to a second protective panel that is configured to extend across a second exterior portion that is adjacent to the first exterior portion.

10. The method of claim 1, further comprising:

selecting a second protective panel including a substantially transparent mesh material;

arranging the second protective panel sheet to extend across and cover a second exterior portion of the structure; and securing the second protective panel onto the first exterior portion.

11. The method of claim 1, wherein the first mesh material comprises a plurality of interconnected strands, and wherein an average thickness of the strands is less than 1 millimeter.

12. The method of claim 1, wherein the first mesh material has a first color substantially similar to a second color of the first exterior portion.

13. A roof protection system comprising a first panel and a second panel, wherein:

a first mesh sheet is bordered by a first rigid frame with a first thickness to form the first panel;

a second mesh sheet is bordered by a second rigid frame with a second thickness to form the second panel;

the first panel is hingedly connected to the second panel;

the first panel covers a first roof portion of a building and the second panel covers a second roof portion of the building; and wherein the first mesh sheet is stretched across a first side of the first rigid frame and is bounded and bordered by the rigid frame.

14. The system of claim 13, wherein the first mesh sheet is substantially elastic.

15. The system of claim 13, wherein the first mesh sheet has a first elasticity and the second mesh sheet has a second elasticity that is less than the first elasticity.

16. The system of claim 13, wherein the first panel includes a plurality of reinforced loops along a peripheral edge of the rigid frame.

17. The system of claim 13, wherein the first mesh sheet is spaced apart from the first roof portion by at least a quarter of an inch.

18. The system of claim 15, wherein the first mesh sheet is spaced apart from the first roof portion by a first distance, the second mesh sheet is spaced apart from the second roof portion by a second distance that is less than the first distance.

19. The system of claim 13, wherein the first mesh sheet is substantially rigid.

20. The system of claim 13, wherein the first panel is secured to the building via rails installed along the first roof portion.

* * * * *